United States Patent [19]

Brown

[11] 4,354,727

[45] Oct. 19, 1982

[54] CONTACT STRIP FOR ELECTRICAL CONNECTOR

[75] Inventor: Donald C. Brown, Westfield, N.J.

[73] Assignee: Heyman Manufacturing Company, Kenilworth, N.J.

[21] Appl. No.: 178,443

[22] Filed: Aug. 15, 1980

[51] Int. Cl.[3] ..... H01R 19/28

[52] U.S. Cl. ..... 339/256 R; 339/192 R; 339/242

[58] Field of Search ..... 339/28, 29 R, 191 R, 339/191 M, 192 R, 256 R, 242, 19

[56] References Cited

U.S. PATENT DOCUMENTS

| | | | |
|---|---|---|---|
| 2,810,895 | 10/1957 | Odegaard | 339/191 M |
| 3,241,096 | 3/1966 | Miller | 339/157 C |
| 3,439,315 | 4/1969 | Hamel | 339/256 R |
| 3,868,163 | 2/1975 | Jarosek | 339/256 R |

FOREIGN PATENT DOCUMENTS

| | | | |
|---|---|---|---|
| 2218017 | 9/1973 | Fed. Rep. of Germany | 339/19 |
| 2423889 | 11/1979 | France | 339/19 |

*Primary Examiner*—John McQuade

*Attorney, Agent, or Firm*—Auslander, Thomas & Morrison

[57] ABSTRACT

Contact portions of a metallic contact strip for an electrical cord connector having mirror-symmetry with respect to a longitudinal axis of symmetry include a plurality of contact portions aligned in the longitudinal direction of the contact strip. Each contact portion is defined by a pair of complementary slits through the material of the contact strip to define a central contact portion and side contact portions. The central and side contact portions are deformed in opposite directions to receive the blade of a connection plug therebetween in 3-point contact. The ends of lengthwise-adjacent slits fall on a transverse line and are displaced from each other in the transverse direction.

7 Claims, 11 Drawing Figures

FIG.1
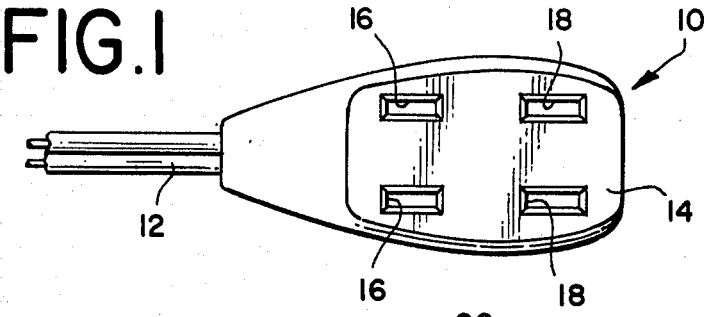
FIG.2
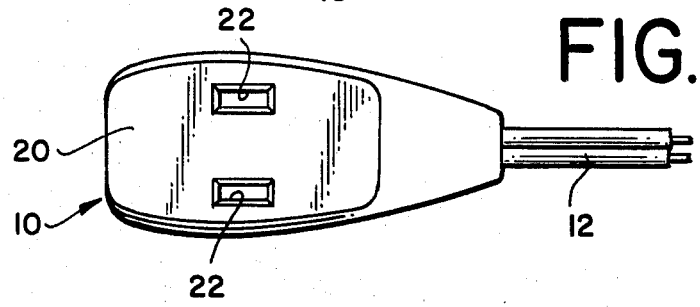
FIG.3
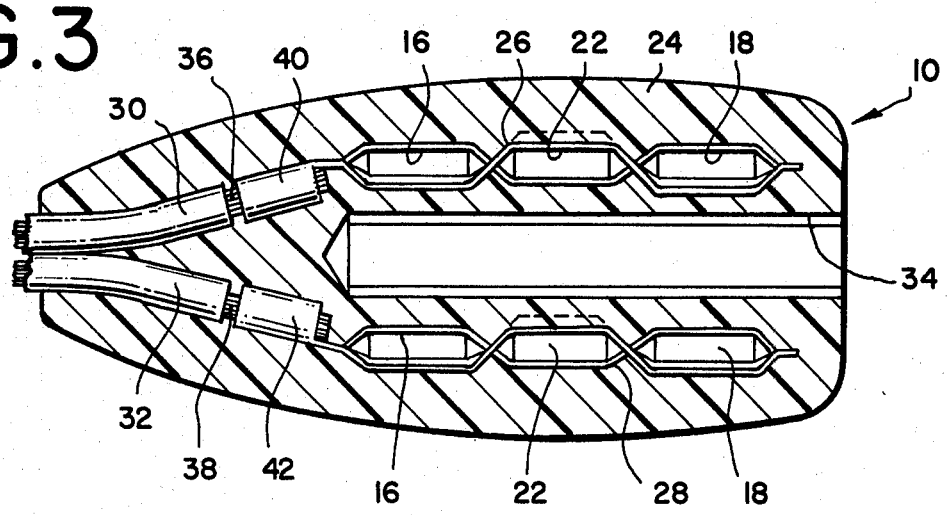
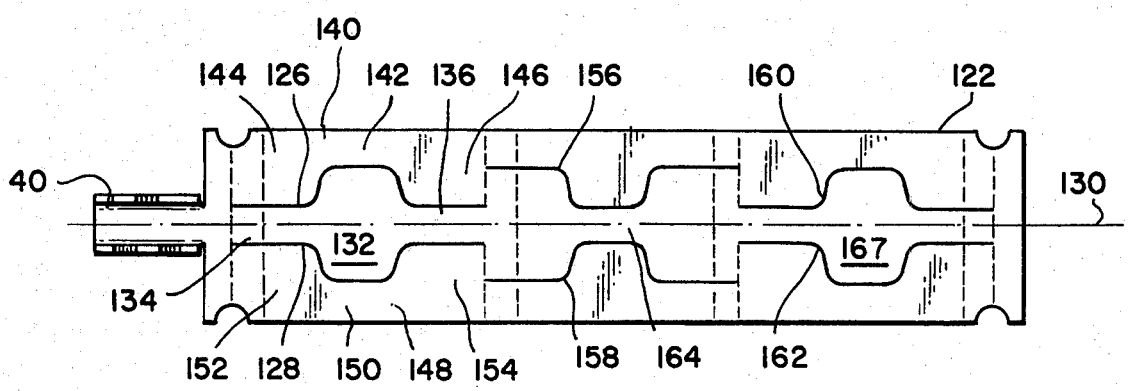
FIG.7

FIG.4
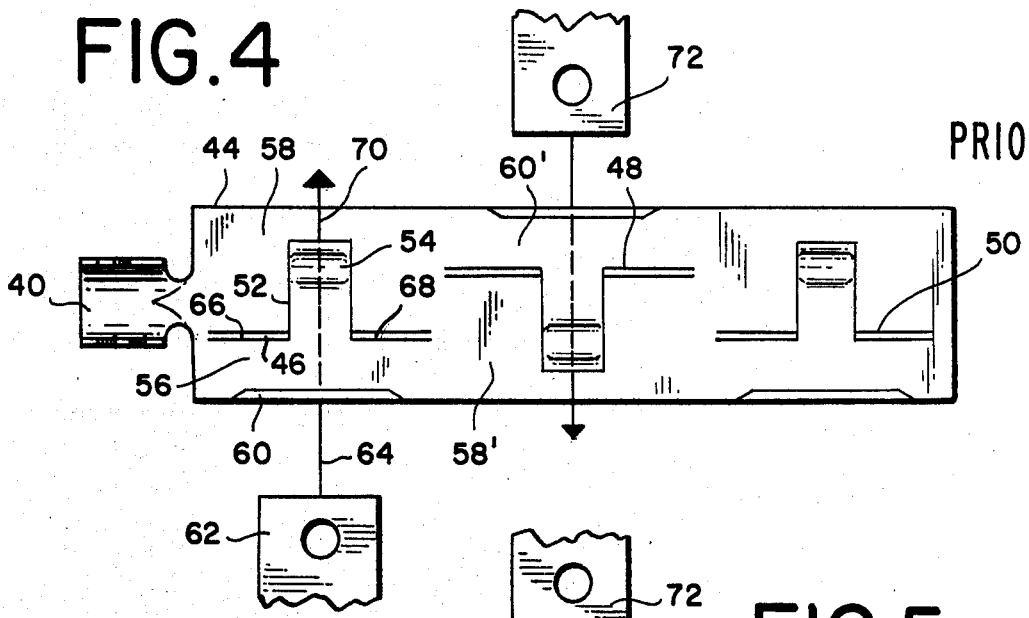
PRIOR ART
FIG.5
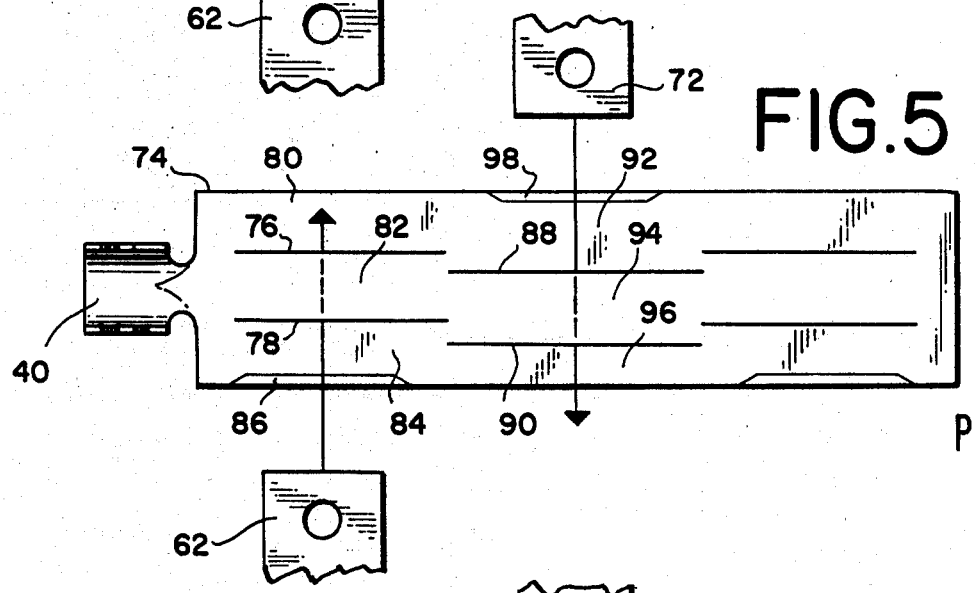
PRIOR ART
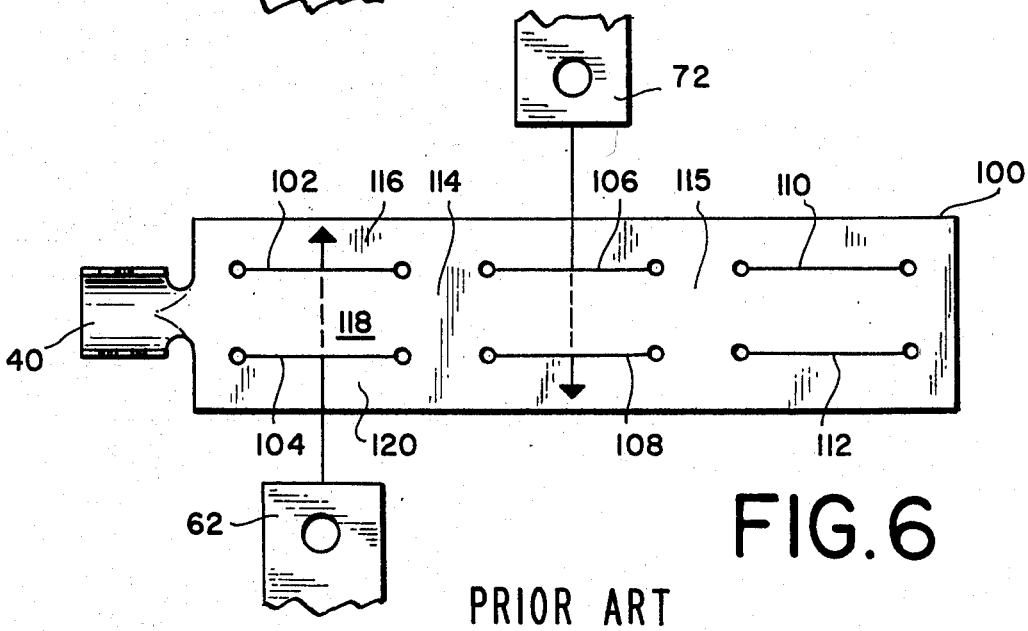
FIG.6
PRIOR ART

FIG.8
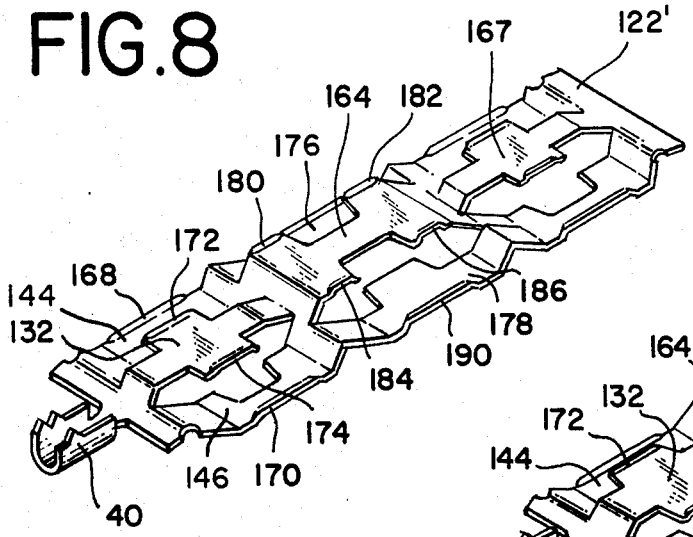
FIG.9
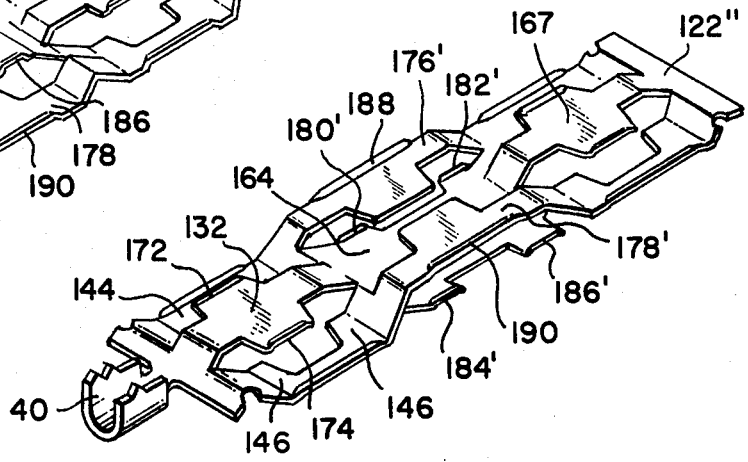
FIG.10
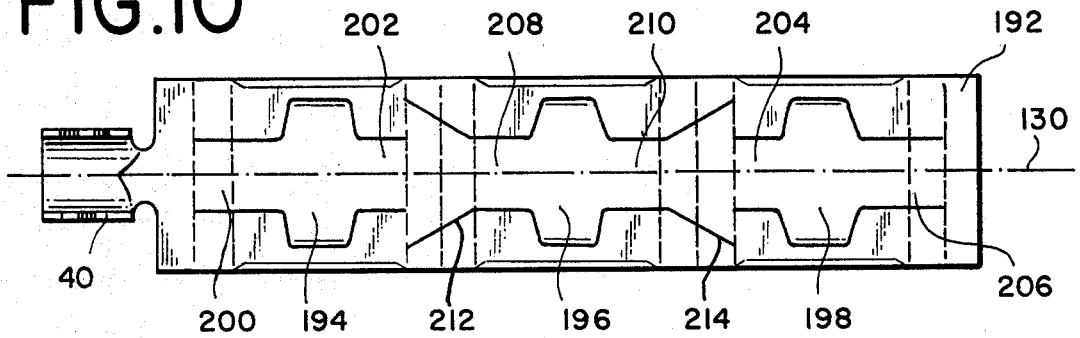
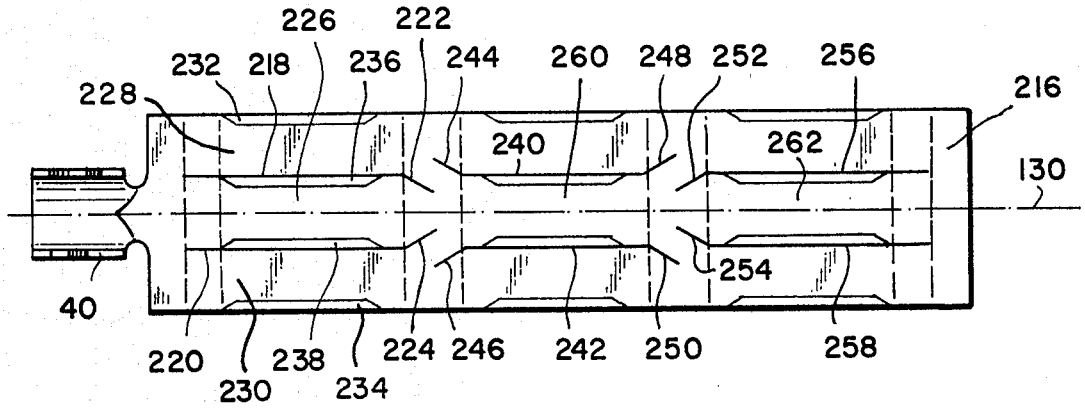
FIG.11

CONTACT STRIP FOR ELECTRICAL CONNECTOR

BACKGROUND OF THE INVENTION

This invention relates to a cord connector for one end of an extension cord and more particularly to a metallic contact strip preferably for molding within a cord connector for making electrical and mechanical connection to a blade of an attachment plug inserted thereinto.

In order to minimize contact resistance, firm contact over as broad an area as possible between a contact strip and the blade of an inserted attachment plug is desired.

In a contact strip disclosed in U.S. Pat. No. 3,241,096, slits through a metallic strip produce two-point contact wherein one part bears against a first side of a blade of an attachment plug and the second part bears against the second side of the blade. Two-point contact of this sort may be unstable and is not capable of applying substantial forces to the blade for low-resistance connection.

The above-referenced U.S. patent also discloses a contact strip providing 3-point contact with a blade of an attachment plug. However, this embodiment requires additional length in the attachment plug.

Three-point contact is also disclosed in a cord connector of U.S. Pat. No. 3,439,315. However, the three metallic strips which form each three-point contact are of unequal width and strength and thereby fail to take full advantage of the strength of the material for maximum force application to the blade of an inserted contact plug.

OBJECTS AND SUMMARY OF THE INVENTION

Accordingly, it is an object of the present invention to provide a contact strip for a cord connector which overcomes the drawbacks of the prior art.

It is a further object of the invention to provide a metallic contact strip having mirror symmetry about a longitudinal axis of symmetry wherein a plurality of contacts are formed each of which employs a pair of slits through a metallic material to define three contact regions in which the outer two regions are deformed in one direction and the center region is deformed in an opposite direction to form an opening. The ends of lengthwise-adjacent slits terminate at substantially equal longitudinal positions along the contact strip but are symmetrically displaced.

According to an aspect of the invention there is provided a contact strip for defining a plurality of openings adapted for the insertion thereinto of blades of electrical attachment plugs comprising, a metallic strip, a connector on the metallic strip for connection to a metallic conductor, first and second complementary longitudinal slits through the metallic strip defining a first central contact strip and first and second side contact strips adjacent opposite sides of the first central contact strip, the first central contact strip being deformed in a first direction with respect to a surface of the metallic strip, the first and second side contact strips being deformed in a second direction with respect to the surface of the metallic strip, the second direction being opposite to the first direction whereby a first of the openings is formed into which one of the blades may be inserted with one surface thereof in contact with the first central contact strip and a second opposed surface thereof in contact with both of the first and second side contact strips, third and fourth complementary longitudinal slits through the metallic strip defining a second central contact strip and third and fourth side contact strips adjacent opposite sides of the second side contact strips, the second central contact strip being deformed in one of the first and second directions, the third and fourth side contact strips being deformed in the other of the first and second directions whereby a second of the openings is formed into which a second of the blades may be inserted, adjacent ends of the first and third and the second and fourth slits ending along a single line transverse to a longitudinal dimension of the metallic strip, the first and second and the third and fourth slits being mirror symmetric with respect to a longitudinal axis of symmetry of the metallic strip, and means for laterally offsetting ends of the third and fourth slits from adjacent ends of the first and second slits.

According to the feature of the invention, there is provided a contact strip for defining a plurality of openings adapted for the insertion thereinto of blades of electrical attachment plugs comprising, a metallic strip, first and second complementary coextensive slits in the metallic strip defining three contact strips which are deformed to provide three-point contact with a blade, third and fourth complementary coextensive slits in the metallic strip displaced longitudinally along the metallic strip from the first and second slits defining three contact strips which are deformed to provide three-point contact with a blade, ends of the first and second slits and the third and fourth slits terminating on a single transverse line, the first and second slits and the third and fourth slits having mirror symmetry with respect to a longitudinal axis of the metallic strip, and means for laterally offsetting the ends of the first and second slits from adjacent ends of the third and fourth slits along the transverse line.

BRIEF DESCRIPTION OF THE DRAWINGS

FIG. 1 is a side view of a cord connector in which the present invention may be employed.

FIG. 2 is an opposite side view of the cord connector of FIG. 1.

FIG. 3 is a cross section corresponding to the side view of FIG. 1.

FIG. 4 is a contact strip for a cord connector according to prior art.

FIG. 5 is a contact strip for a cord connector according to prior art.

FIG. 6 is a contact strip for a cord connector according to prior art.

FIG. 7 is a plan view of a cord connector according to a first embodiment of a present invention.

FIG. 8 is a perspective view of the contact strip of FIG. 7.

FIG. 9 is a perspective view of a contact strip according to FIG. 7 with the contact areas differently deformed than in FIG. 8.

FIG. 10 is a contact strip according to a further embodiment of the present invention.

FIG. 11 is a contact strip according to yet another embodiment of the present invention.

DETAILED DESCRIPTION OF THE PREFERRED EMBODIMENTS

The present invention is employed in a cord connector such as cord connector 10 in FIG. 1 at one end of a flexible electric cord 12 of an extension cord. Cord connector 10 has a substantially planar side face 14 having a first pair of parallel rectangular openings 16 adapted for insertion thereinto of the two blades (not shown) of a conventional attachment plug. A second pair of parallel rectangular openings 18 are spaced from rectangular openings 16 and are also adapted for insertion of the blades of an attachment plug.

Referring now to FIG. 2, the opposite side of cord connector 10 includes a substantially planar side face 20 having a further pair of parallel rectangular openings 22 centrally disposed in the length of thereof.

Referring now to the cross section in FIG. 3, cord connector 10 is seen to be a mass of plastic material 24, preferably of polyvinyl chloride or other suitable molded insulating material, molded about first and second metallic contact strips 26 and 28 and the inner ends 30 and 32 of the two conductor portions of flexible electric cord 12. A central longitudinal opening 34 in plastic material 24 permits the discharge of heat which may developed in metallic contact strips 26 and 28 as well as reduces the amount, cost and weight of plastic material employed in forming cord connector 10.

The extremities of inner ends 30 and 32 are stripped of insulation to reveal metallic conductors 36 and 38 about which connector tabs 40 and 42 are bent and tightly crimped to provide mechanical and electrical connection between metallic contact strips 26 and 28 and metallic conductors 36 and 38.

In cord connector 10, it is desirable to obtain contact between metallic contact strips 26 and 28 and inserted blades of attachment plugs which provides the lowest of possible contact resistance and it is desirable to accomplish this using a minimum of metal in contact strips 26 and 28. It is also desirable to keep the length of cord connector 10 at a minimum in order to minimize the materials used therein. Thus, it is desirable to have the pairs of openings 16, 22, 18 as close to each other as possible in the lengthwise direction. That is, openings 16 should be as close as possible to openings 22 which, in turn, should be as close as possible to openings 18.

Low contact resistance is accomplished by providing stable mechanical contact between as large an area as possible of metallic contact strips 26 and 28 with the blades of attachment plugs inserted thereinto. Low contact resistance is further enhanced by application of force between contact strips 26 and 28 and the blades of contact plugs inserted thereinto.

One attempt to achieve stable wide area contact employed in the prior art is illustrated in FIG. 4. A contact strip 44 formed of any convenient material such, for example, a rectangular flat strip of beryllium bronze as three zig-zag slits 46, 48 and 50 completely through contact strip 44. Each zig-zag slit 46, 48 and 50 is associated with one of parallel rectangular openings 16, 18 and 20 (FIGS. 1–3).

Zig-zag slit 46 defines a finger 52 having a longitudinal dimple or depression 54 therein. The material 56 on one side of zig-zag slit 46 is deformed from a plane out of the page in FIG. 4. The material 58 is deformed downward or into the page in FIG. 4 to create an opening seen edge on corresponding to opening 16 in FIG. 3. A deformed edge 60 of upward deformed material 56 is angled out of the page in order to provide a guide surface for entry of a blade 62 below material 56 as indicated by the dashed portion 64 of an arrow indicating the insertion direction of blade 62. Edges 66 and 68 of portion 58 may be deformed downward or toward the page in order to guide blade 62 on top of portion 58. As blade 62 slides into its fully inserted position as indicated by the solid end 70 of the arrow, depression 54 bears against the upper surface of blade 62 in order to pinch blade 62 between itself and downward deformed portion 58.

Zig-zag slit 48 corresponds to opening 22 (FIG. 3) in a manner similar to the creation of an opening by zig-zag slit 46 and the deformation of the material of contact strip 44. Except for the orientation of the contact for a blade 72 being rotated 180 degrees about an axis vertical to the plane of the figure, zig-zag slit 48 produces a contact analogous to the contact produced by zig-zag slit 46.

It should be noted that the right-most end of zig-zag slit 46 is located at the same lengthwise position along contact strip 44 as the left-most end of zig-zag slit 48 and contact therebetween is prevented by the lateral offset thereof. Similarly, the right-most end of zig-zag slit 48 is at the same lengthwise position on contact strip 44 as the left-most end of zig-zag slit 50. This arrangement of zig-zag slits 46,48 and 50 permits minimum length to be consumed by contact strip 44. However, this arrangement also requires that the ends of the zig-zag slits be offset from one another in the crosswise dimension of contact strip 44. Thus, upward deformed portion 56 must necessarily be narrower than downward deformed portion 58 in order that corresponding portions 58' and 60' of the adjacent contact portion defined by zig-zag slit 48 permit offsetting the ends of zig-zag slits 46 and 48. Since portion 56 is narrower than the major parts of portion 58, it has reduced strength and resilience. Consequently, the pressure which can be applied on blade 62 for good mechanical and stable electrical contact is reduced. In addition, an unstable 2-point contact, rather than a stable 3-point contact, is made between contact strip 44 and blade 62. Also, the cantilevering of finger 52 supported by the relatively narrow section of portion 56 may permit finger 52 and portion 56 to deform about an axis parallel to the lengthwise dimension of contact strip 44 to further reduce the pressure which can be brought to bear on blade 62.

One attempt to improve mechanical contact between a contact strip and an inserted blade is illustrated in contact strip 74 in FIG. 5 which corresponds generally to the disclosure of U.S. Pat. No. 3,439,315, herein incorporated by reference. A first pair of parallel longitudinal slits 76 and 78 completely through the material of contact strip 74 divide a first contact portion of contact strip 74 into first, second and third parallel metallic strips 80, 82 and 84. Metallic strip 82 is deformed out of the page and metallic strips 80 and 84 are deformed into the page to provide an opening corresponding to openings 16 in FIG. 3. A downwardly deformed edge 86 on metallic strip 84 may be employed to assist in guiding blade 62 into position over strip 84, under strip 82 and over strip 80 as shown by solid and dashed portions of an arrow. A second pair of slits 88 and 90, offset in the lateral direction from slits 76 and 78 divide a central portion of contact strip 74 into metallic strips 92, 94 and 96. A downwardly deformed edge 98 may be provided for guiding blade 72 over strip 92 from whence it passes under strip 94 and over strip 96 as indicated by the solid and dashed portions of an arrow extending from blade 72.

Since the pair of slits 88 and 90 begin at the same lengthwise position on contact strip 74 as the pair of slits 76 and 78 end thereon, the crosswise positions of the two pairs of slits must be offset. Thus, strip 84 is wider than strip 80 and strip 92 is wider than strip 96. This arrangement takes advantage of less than maximum strength from the material of the strips than would be available if they were of the same width.

Referring now to FIG. 6, there is shown a contact strip 100 of the prior art having a first pair of slits 102 and 104 aligned end to end with a second pair of slits 106 and 108 which are, in turn, aligned end to end with a third pair of slits 110 and 112. The ends of slits 102 and 104 are separated by a gap 114 from the adjacent ends of slits 106 and 108. Similarly, the ends of slits 106 and 108 are separated by a gap 115 from the adjacent ends of slits 110 and 112. Slits 102 and 104 form three metallic strips 116, 118 and 120. Since slits 102 and 104 need not be offset from slits 106 and 108, strips 116 and 120 may be of equal width for maximum benefit from the strength of the material of contact strip 100. Similarly, the metallic strips formed by the remaining slits 106, 108, 110 and 112 can have the same widths as metallic strips 116, 118 and 120.

Although the embodiment of contact strip 100 shown in FIG. 6 takes maximum strength advantage of the material, the fact that the pairs of slits must be separated in the lengthwise direction adds significantly to the length of contact strip 100. This, of course, entails greater material in contact strip 100 as well as a significantly increased amount and length of molded plastic required to form cord connector 10 (FIG. 3).

Referring now to FIG. 7, there is shown a contact strip 122 according to a first embodiment of the invention. A first pair of zig-zag slits 126 and 128 are arranged in mirror-image symmetry on opposite sides of a longitudinal axis of symmetry 130 to form a central portion 132 joined to the remainder of contact strip 122 by two relatively narrow end tabs 134 and 136. End tabs 134 and 136 support between them a relatively wide central contact portion 132. An outside portion 140 formed by slit 126 has a relatively narrow central contact portion 142 joined to two relatively wide side contact portions 144 and 146. The distal ends of side contact portion 144 and 146 are connected to the remainder of contact strip 122. Similarly, a second outside portion 148 is mirror-symmetric to outside portion 140 with a relatively narrow central contact portion 150 and relatively wider side contact portions 152 and 154 connected at the distal ends thereof to the remainder of contact strip 122.

A second pair of zig-zag slits 156 and 158 are complementary to zig-zag slits 126 and 128. That is, zig-zag slits 156 and 158 are separated widely apart in places where zig-zag slits 126 and 128 are close together and are spaced close together where zig-zag strips 126 and 128 are spaced far apart. Thus, the left ends of zig-zag slits 156 and 158 are spaced considerably wider apart than the right ends of zig-zag slits 126 and 128. This permits mirror-image symmetry to be obtained and provides 3-point contact with blades (not shown) of an attachment plug without giving up either the stability of contact available from symmetry and 3-point contact and without adding to the overall length of contact strip 122. A third pair of zig-zag slits 160 and 162, identical to zig-zag slits 126 and 128 form a third contact.

The slitted contact strip 122 of FIG. 7 may be deformed to produce openings 16, 18 and 22 (FIG. 3) either as shown at 122' in FIG. 8 by deforming central portions 132, 164 and 168 all in the same direction out of the page while deforming the remainder of the contact portions toward the page or, as shown at 122" in FIG. 9, by deforming central portions 132 and 168 closer to the ends of contact strip 122" out of the page and depressing central portion 164 toward the page with opposite treatment of the side contact portions. By properly proportioning the central and side contact portions, any ratio of contact areas on opposed sides of the blade (not shown) of an attachment plug may be obtained. If equality of contact area is desired, then the sum of contact areas achieved by contact of side contact portions 144 and 146 may be made equal to the contact area of central contact portion 132.

Referring again to FIG. 8, it should be noted that the outer edges of both side contact portion 144 and 146 of contact strip 122' are deformed into downward deflected portions 168 and 170 respectively to guide the blade of an attachment plug for insertion from either side. Similarly, the outer edges of central portion 132 may be deformed upward to produce upward deflected portions 172 and 174 to guide the blade (not shown) of an attachment plug under central portion 132. A similar treatment is applied to the center contact area including central contact portion 164 and side contact portions 176 and 178. Edges on each side of central contact portion 164 are deflected upward to form upward deflected portions 180, 182, 184 and 186 for guiding the blade of an attachment plug (not shown) under central contact portion 164.

Referring again to FIG. 9, contact strip 122" is the same as contact strip 122' except for the arrangement of the central contact portion, the use of upward deflected portions 188 and 190 at the edges of side contact portions 176' and 178' rather than downward deflected portions 176 and 178 as in FIG. 8 and the use of downward deflected portions 180', 182', 184', and 186' rather than their upward deflected counterparts of FIG. 8.

Although the complementary symmetry between the center and ends of contact strips 122' and 122" of FIGS. 8 and 9 provides a minimum-length contact strip giving stable 3-point contact with a blade of an attachment plug which can be inserted from either direction, the fact that the portions of the connectors near the ends are wide where those in the center connector are narrow and vice-versa may produce different contact pressures on the blade of an attachment plug depending upon which of the openings receives the blade. The embodiment of the invention in FIG. 10 overcomes this problem.

Contact strip 192 includes three central contact portions 194, 196 and 198 having approximately the same shape and having mirror-image symmetry with respect to a longitudinal axis of symmetry 130. Central contact portion 194 is connected to the remainder of contact strip 192 by relatively narrow end tabs 200 and 202. Central contact portion 198 is similarly connected to the remainder of contact strip 192 by relatively narrow end tabs 204 and 206. Central contact portion 196 in the middle of contact strip 192 is connected to end tabs 208 and 210 which are, in turn, connected to V-shaped portions 212 and 214, the distal ends of which are connected to the remainder of contact strip 192. End tabs 208 and 210 have a width which is substantially equal to the widths of end tabs 200, 202, 204 and 206 and thus provide a strength which is substantially similar to their counterparts. Furthermore, substantially all of the contact takes place on central contact portions 194, 196 and 198 and the parts of end tabs 200,202, 204, 206, 208 and 210 which are immediately adjacent to central contact portions 194, 196 and 198. Therefore, the fact that end tabs 208 and 210 do not connect directly to the remainder of contact strip 192, but instead, are joined thereto through V-shaped portions 212 and 214 does not substantially change the area in contact with a blade of an attachment plug as compared to the contact area achieved in remaining portions of contact strip 192.

It would be clear to one skilled in the art that central contact portions 194, 196 and 198 may be deformed downward or upward with respect to the remainder of contact strip 192. Furthermore, one or more of central contact portion 194, 196 and 198 may be depressed downward and the remainder may be deformed upward without departing from the scope of the present invention.

Referring now to FIG. 11, there is shown a contact strip 216 according to a further embodiment of the invention. Contact strip 216 exhibits mirror symmetry about a longitudinal axis of symmetry 130 and includes first and second essentially straight slits 218 and 220 terminating at their inboard ends in inward-directed angled portions 222 and 224 respectively to define a central contact portion 226 flanked by side contact portions 228 and 230. The outer edges of side contact portion 228 and 230 are deformed upward or downward to produce upward or downward deformed portions 232 and 234 respectively, the direction of deformation depending upon the manner in which the blade (not shown) of an attachment plug is to be inserted. Both edges of central contact portion 226 are deformed upward or downward to form deformed portions 236 and 238 which are deformed in a direction complementary to the deformation of deformed portions 232 and 234.

It should be noted that deformed portions 236 and 238 essentially form a corrugation on the edges of central contact portion 226 to thereby enhance the rigidity of central contact portion 226 and to increase the force which central contact portion 226 may apply to the blade (not shown) of an attachment plug inserted into contact strip 216.

A second pair of substantially straight slits 240 and 242 respectively terminate at their left ends in outward angled portions 244 and 246 which end at the same lengthwise positions along contact strip 216 as do inward angled portions 222 and 224 of slits 218 and 220. Similarly, the right ends of slits 240 and 242 terminate in outward angled portions 248 and 250 which end at the same lengthwise position along contact strip 216 as do the left ends of inward angled portions 252 and 254 of slits 256 and 258.

As previously described, those parts of central contact portions 226, 260 and 262 which are bordered by other than straight and parallel sides are generally out of contact with an inserted blade (not shown) of an attachment plug. Therefore, uniform contact resistance and force should be exerted on a contact plug by any one of central contact portions 226, 260, and 262 as well as by the adjacent side contact portions. In addition, the effective corrugation provided by the deformed edges of central contact portions 226, 260 and 262 increase the amount of contact pressure which may be applied.

Having described specific preferred embodiments of the invention with reference to the accompanying drawings it is to be understood that the invention is not limited to those precise embodiments and that various changes and modifications may be effected therein by one skilled in the art without departing from the scope or spirit of the invention as defined in the intended claims.

What is claimed is:

1. A contact strip for defining a plurality of openings adapted for the insertion thereinto of blades of electrical attachment plugs comprising:

a metallic strip;

a connector on said metallic strip for connection to a metallic conductor;

first and second complementary longitudinal slits through said metallic strip defining a first central contact strip and first and second side contact strips adjacent opposite sides of said first central contact strip;

said first central contact strip being deformed in a first direction with respect to a surface of said metallic strip;

said first and second side contact strips being deformed in a second direction with respect to said surface of said metallic strip, said second direction being opposite to said first direction whereby a first of said openings is formed into which one first of said blades may be inserted with one surface thereof in contact with said first central contact strip and a second opposed surface thereof in contact with both of said first and second side contact strips;

third and fourth complementary longitudinal slits through said metallic strip defining a second central contact strip and third and fourth side contact strips adjacent opposite sides of said second central contact strip;

said second central contact strip being deformed in one of said first and second directions;

said third and fourth side contact strips being deformed in the other of said first and second directions whereby a second of said openings is formed into which a second of said blades may be inserted;

adjacent ends of said first and third and said second and fourth slits ending along a single line transverse to a longitudinal dimension of said metallic strip;

said first and second and said third and fourth slits being mirror symmetric with respect to a longitudinal axis of symmetry of said metallic strip; and means for laterally offsetting ends of said third and fourth slits from adjacent ends of said first and second slits.

2. A contact strip according to claim 1 wherein said first and second slits are complementary zig-zag slits and said third and fourth slits are zig-zag slits which are complementary to each other and to said first and second slits, said means for laterally offsetting being the complementary relationship between said first and second and said third and fourth slits.

3. A contact strip according to claim 1 wherein said means for laterally offsetting includes inward directed V-shaped ends on said first and second slits adjacent said single line and outward directed V-shaped ends on said third and fourth slits adjacent said single line.

4. A contact strip according to claim 1 wherein said first and second slits have substantially straight sides parallel to said axis of symmetry with V-shaped ends directed one of inward and outward at ends thereof adjacent said single line and said third and fourth slits having substantially straight parallel sides parallel to said axis of symmetry with V-shaped ends directed the other of inward and outward.

5. A contact strip according to claim 1 wherein said first central contact strip includes a first deformed portion along a first lateral edge thereof and a second deformed portion along a second lateral edge therein, said first and second deformed portions being effective to guide said first surface of said blade into contact with one surface of said central contact strip and being further effective to form longitudinal corrugations which stiffen said central contact strip against deformation by said blade whereby greater contact pressure is exerted on said blade.

6. A contact strip for defining a plurality of openings adapted for the insertion thereinto of blades of electrical attachment plugs comprising:

a metallic strip;

first and second complementary coextensive slits in said metallic strip defining three contact strips which are deformed to provide three-point contact with a blade;

third and fourth complementary coextensive slits in said metallic strip displaced longitudinally along said metallic strip from said first and second slits defining three contact strips which are deformed to provide three-point contact with a blade;

ends of said first and second slits and said third and fourth slits terminating on a single transverse line;

said first and second slits and said third and fourth slits having mirror symmetry with respect to a longitudinal axis of said metallic strip; and means for laterally offsetting said ends of said first and second slits from adjacent ends of said third and fourth slits along said transverse line.

7. A contact strip according to claim 6 wherein said first and second slits are zig-zag slits and said means for laterally offsetting includes said third and fourth slits being complementary with respect to said first and second slits.

* * * * *